US010993031B2

(12) United States Patent
Bian

(10) Patent No.: US 10,993,031 B2
(45) Date of Patent: Apr. 27, 2021

(54) TRANSDUCER VIBRATING DIAPHRAGM STRUCTURE, FLAT PANEL SPEAKER AND EARPHONE THEREWITH

(71) Applicant: Fang Bian, Tianjin (CN)

(72) Inventor: Fang Bian, Tianjin (CN)

( * ) Notice: Subject to any disclaimer, the term of this patent is extended or adjusted under 35 U.S.C. 154(b) by 51 days.

(21) Appl. No.: 16/575,073

(22) Filed: Sep. 18, 2019

(65) Prior Publication Data

US 2020/0092652 A1 Mar. 19, 2020

(30) Foreign Application Priority Data

Sep. 18, 2018 (CN) ..... 201811084889.0

(51) Int. Cl.

| | |
|---|---|
| ***H04R 7/04*** | (2006.01) |
| ***H04R 7/18*** | (2006.01) |
| ***H04R 9/04*** | (2006.01) |
| ***H04R 9/06*** | (2006.01) |

(52) U.S. Cl.

CPC ..... *H04R 7/04* (2013.01); *H04R 7/18* (2013.01); *H04R 9/047* (2013.01); *H04R 9/066* (2013.01)

(58) Field of Classification Search

CPC . H04R 7/18; H04R 9/047; H04R 9/07; H04R 9/08; H04R 9/066; H04R 7/04; H04R 1/1016; H04R 9/06; H04R 1/1075

USPC ..... 381/408, 191, 175, 177, 152, 431

See application file for complete search history.

(56) References Cited

U.S. PATENT DOCUMENTS

| | | | | |
|---|---|---|---|---|
| 2004/0218779 | A1* | 11/2004 | Fukuyama | H04R 9/02 381/409 |
| 2007/0165887 | A1* | 7/2007 | Shin | H04R 9/045 381/152 |
| 2010/0177927 | A1* | 7/2010 | Sano | H04R 31/00 381/400 |

FOREIGN PATENT DOCUMENTS

| | | | |
|---|---|---|---|
| CN | 103763652 A | * | 4/2014 |
| CN | 103763652 A | | 4/2014 |

* cited by examiner

*Primary Examiner* — Alexander Krzystan
*Assistant Examiner* — Julie X Dang
(74) *Attorney, Agent, or Firm* — BakerHostetler

(57) ABSTRACT

An earphone comprising a transducer vibrating diaphragm structure is described herein. The transducer vibrating diaphragm structure comprises a diaphragm including a first surface and a second surface opposite the first surface, a first frame and a second frame disposed at two sides of the diaphragm and coupled to a periphery of the diaphragm, a first magnetic element and a second magnetic element disposed to correspond to the first surface and the second surface, respectively. A total area of the diaphragm is less than or equal to 120 square millimeters and a sensitivity of the diaphragm is greater than 105 dB.

20 Claims, 3 Drawing Sheets

TRANSDUCER VIBRATING DIAPHRAGM STRUCTURE, FLAT PANEL SPEAKER AND EARPHONE THEREWITH

CROSS-REFERENCE TO RELATED APPLICATIONS

The present disclosure claims priority of Chinese Patent Application No. 201811084889.0 filed on Sep. 18, 2018, the entire contents of which are hereby incorporated by reference.

Some references, if any, which may include patents, patent applications and various publications, may be cited and discussed in the description of this disclosure. The citation or discussion of such references, if any, is provided merely to clarify the description of the present disclosure and is not an admission that any such reference is "prior art" to the disclosure described herein. All references listed, cited or discussed in this specification are incorporated herein by reference in their entireties and to the same extent as if each reference was individually incorporated by reference.

BACKGROUND

Currently, electroacoustic speakers can be roughly divided into moving-coil speakers, electrostatic speakers and flat panel speakers (which are also called as constant magnetic speakers) according to classification of driving ways.

(1) Moving-coil speakers: they are the most common speakers, and have the most mature technology, and the driving unit drives a vibrating diaphragm connected with a voice coil to vibrate via the voice coil in a permanent magnetic field. The moving-coil speakers are high in efficiency, most of them can output a drive for the acoustic speakers, and they are reliable and durable. Please refer to a working principle diagram of conventional moving-coil earphone in FIG. 1.

(2) Electrostatic speakers: the electrostatic speakers have a light and thin vibrating diaphragm that is polarized by a high DC voltage. Electric energy required by polarization is converted from an alternating current, and some are also supplied by a battery. The vibrating diaphragm is hanged in an electrostatic field formed of two fixed metal plates (stators), and when an audio signal is loaded onto the stators, the electrostatic field changes to drive the vibrating diaphragm to vibrate. A single stator also may drive the vibrating diaphragm, but the push-pull form of double stators has smaller distortion. The electrostatic speakers must use a special amplifier to convert the audio signal into voltage signal of hundreds of volts. The electrostatic speakers also may be driven through the method of connecting a transformer on an output end of a power amplifier, and such scheme has been widely adopted on the electrostatic speakers in 1960s and 1970s, which is a compromise to expensive costs of the amplifier of the electrostatic speakers, because the signal quality cannot reach the level of the amplifier of the specially designed electrostatic speakers. The electrostatic speakers have a precise structure, and have a high demand on the material, and since most of them are manually assembled and debugged, they are expensive in price. The electrostatic speakers are often considered to provide high-quality audio reproduction, and are mainly applied to high grade speakers and sound boxes. The principle of the traditional electrostatic speakers is that two fixed electrode plates (which often use PCBs, metal plates, and metal plates with insulating layers) with openings clamping a conductive vibrating diaphragm forms a capacitor, and brings the vibrating diaphragm to vibrate and radiate the sound out using an electrostatic force generated from positive and negative electric fields by supplying a DC bias voltage to the vibrating diaphragm and giving an audio AC voltage to the two electrodes. In order to reduce vibration mass of the vibrating diaphragm, the structure of the vibrating diaphragm mostly uses an insulation film, and an extremely thin electrical conductive coating, such as, metal and semiconductor, is electroplated on a surface layer of the insulation film.

After comparison, relative to the most common moving-coil speakers, the successor electrostatic speakers have great advantages: one is that the vibrating diaphragm may be quite thin and light, for example, a vibrating diaphragm of the newer generation of medium and high grade electrostatic speakers has a thickness of about 1.35 μm, which is unreachable anyhow for the vibrating diaphragm of the moving-coil speakers. Currently, the vibrating diaphragm of the highest grade moving-coil speakers also has a thickness of at least 5 μm, because the moving-coil vibrating diaphragm must remain a certain rigidity, and the weight of the voice coil is also far greater than that of the electrostatic speakers. Lighter and thinner vibrating diaphragm of the electrostatic speakers brings faster speed, better transient response and stronger detail expressive force. Secondly, no matter how the vibrating diaphragm of the moving-coil speakers designs, the vibrating diaphragm suffers from a non-uniform force, and has segmented vibration. However, the vibrating diaphragm of the electrostatic speakers is a total planar vibrating diaphragm sandwiched between two parallel and fixed positive and negative electrode plates, and suffers from a completely uniform electric field, so it can be driven linearly, and does not have segmented vibration. Such limitation of the moving-coil speakers will not occur on the electrostatic speakers. Thirdly, the electrostatic speakers are well designed in structure, and also have a larger area in controlling the vibrating diaphragm than the speakers with moving-coil technology, so as compared to the speakers with moving-coil technology, the electrostatic speakers are higher in sensitivity, can replay each detail on the scene, are lower in distortion, and are also better in tone quality, such that the ears feel more comfortable in listening.

As compared to the moving-coil speakers, the electrostatic speakers also have obvious disadvantages: firstly, in terms of price, the moving-coil speakers have a mature technology and high reliability, so they are first choice for most speakers. The electrostatic speakers are complicated in fabrication, and the fabrication technology is only grasped by a few companies, so the price is extremely expensive. Secondly, the electrostatic speakers are easily damaged when they are in an environment with higher humidity or dust. A part of users who use the electrostatic speakers even need to equip a specialized moisture-proof box for storage, and maintenance is troublesome. As a complete set of system is large in both dimension and weight, it is not convenient for carrying, and reliability and lifetime are less than the conventional moving-coil speakers due to limitation of fabrication precision itself. In addition, as the electrostatic speakers are large in volume and weight, and are difficult to be driven, they can be used only with specialized front end, and are pre-heated for a period of time when turning on each time. What is the most fatal thing is that a stroke of the vibrating diaphragm of the electrostatic speakers is restricted due to the distance between the stator and the vibrating diaphragm is limited, and a sound pressure level to be reached is smaller than the moving-coil speakers, i.e., the low-frequency stage does not perform well. Please refer to a working principle diagram of conventional electrostatic earphone in FIG. 2.

(3) Flat panel speakers: a driver of the flat panel speakers is similar with a reduced plane speaker, and a plane voice coil is embedded in a light and thin vibrating diaphragm. Magnets are concentrated on one side or both sides (push-pull type) of the vibrating diaphragm, and the vibrating diaphragm vibrates in the formed magnetic field. Generally, a flat panel unit often supplies a permanent magnetic field via two electrode plates, and is printed with a fine circuit in the magnetic field. An electrical signal is connected to the printed circuit on the vibrating diaphragm to generate positive and negative charges in the magnetic field, because the entire vibrating diaphragm is uniformly printed with a conductive circuit. Current flowing within the circuit is orthogonal to the magnetic field generated by the permanent magnets, the circuit generates a force following Faraday's law by flowing an AC current in the circuit, and the vibrating diaphragm vibrates in a vertical direction under the action of the force, thereby generating vibration, and converting an AC current signal into a sound signal. Such sound production principle is similar with an electrostatic unit, but has quite different forms concerning technical details, and possesses many characteristics similar with the electrostatic unit, such that it can achieve the effect of excellent extension, good transient and small distortion. In addition, in the sense of hearing, sound field and sound image of the traditional moving-coil speakers can only be concentrated in regions of the range of ears and skull, while the flat panel speakers have larger sound field and sound image, which can fill the entire head space and extend to the shoulder, such that the sound will be more real, relaxed and natural. Please refer to a working principle diagram of conventional flat panel earphone in FIG. 3.

In conclusion, the flat panel speakers can be regarded as combining the advantages of both the moving-coil speakers and the electrostatic speakers. As compared with the electrostatic types, they possess better performance in low frequency, and are also better than the moving-coil types in high frequency. Since the flat panel speakers are driven without a raising voltage required for the electrostatic speakers, the use barrier is lower than the electrostatic unit.

However, in design of the transducer of the flat panel speakers, the coil mass has a direct influence on the sound production effect of the transducer. When the voice coil is heavy, it causes low high-frequency response, and reduces resonant frequencies within a high vocal range. Moreover, when the vibration mass is large, due to a large inertia, transient characteristic of the sound becomes worse, so when designing the flat panel transducer, it is often hoped to obtain a lower coil mass. The coil material of a part of flat panel speaker products is made of a metal material with good ductility, such that a thickness of the coil can reach to nanoscale, so as to largely reduces the coil mass, and hence obtains an excellent transient and resolution power. However, due to limitation of a dimension of the vibrating diaphragm, the coil material with good ductility must be densely covered on the vibrating diaphragm having a larger dimension, so the flat panel speakers are mostly applied to electronic devices with a larger dimension, such as, sound box, headset, etc. Moreover, when the dimension of the vibrating diaphragm is reduced, the surface area of the vibrating diaphragm cannot satisfy arrangement of enough coils, and even if the surface of the vibrating diaphragm is fully arranged with coil circuits, distortion phenomenon will still occur. Therefore, relationship among mass-thickness-area of the available coil cannot be applied to an earplug with a smaller dimension. Currently, as an area of the flat panel is reduced, sound quality (sensitivity) of the flat panel speakers will also dramatically decrease, and at present, no one in the field successfully applies the flat panel vibrating diaphragm speakers to the field of in-ear earplug.

Secondly, the available similar products mostly achieve miniaturization of flat panel vibrating diaphragm speakers by placing a larger flat panel vibrating diaphragm unit in the auricle portion of human, and does not achieve the in-ear effect of the vibrating diaphragm unit in a real sense, let alone allowing the earplug to achieve the technical effect of having larger sound field and sound image as the headset, which can fill the entire head space and extend to the shoulder, such that the sound will be more real, relaxed and natural, and achieving a quiet effect of fully insulating sound.

Meanwhile, in the procedure of researching and developing the speakers, the final tone tuning style always depends on actual listening of human ears, and it means that in order to grasp an ideal thickness, area and mass of the coil circuit, or intervals thereof, a large number of vibrating diaphragms with different coil thicknesses, areas and masses are fabricated, which not only sets a high demand on the fabrication process of the flat panel speakers, and the research and development costs are too high and the research and development cycle is too long, which is difficult for the corporations to afford.

SUMMARY OF THE DISCLOSURE

With respect to the structural disadvantages in the prior art, an object of the present disclosure is to provide a transducer vibrating diaphragm of a miniature flat panel speaker and a speaker structure having the same, which can reduce a dimension of the flat panel vibrating diaphragm speaker within 120 square millimeters under the circumstance of ensuring a sensitivity to be greater than 105 dB, and innovatively apply the flat panel vibrating diaphragm speaker to the field of in-ear earplug that can be placed into an external auditory canal of human, such that the earplug also can have larger sound field and sound image to fill the entire head space and extend to the shoulder, while achieving a quiet effect of fully insulating sound.

In order to achieve the above object of the invention, a transducer vibrating diaphragm of a miniature flat panel speaker of the present disclosure is implemented through the following technical solutions:

A transducer vibrating diaphragm structure of a flat panel speaker, comprising a vibrating diaphragm having a first plane shape and a periphery fixed on a first coil skeleton and a second coil skeleton, the vibrating diaphragm comprising a first surface and a second surface, the first coil skeleton and the second coil skeleton are respectively located on the first surface and the second surface of the vibrating diaphragm and fixedly connected to the vibrating diaphragm, and the first sub-coil circuit and the second sub-coil circuit formed of a conductive material in a regular wiring are arranged on the vibrating diaphragm, characterized in that the transducer vibrating diaphragm structure has a total area no more than 120 square millimeters, and a sensitivity greater than 105 dB, the first sub-coil circuit and the second sub-coil circuit on the vibrating diaphragm are correspondingly provided with a first magnetic skeleton and a second magnetic skeleton on which a first magnetic element and a second magnetic element are correspondingly arranged, respectively, and the first sub-coil circuit and the second sub-coil circuit are deposited on the first surface and the second surface of the vibrating diaphragm through vapor deposition or liquid deposition, and correspondingly form a first sub-coil and a second sub-coil of a series or parallel circuit.

Projections of the first sub-coil and the second sub-coil on the first surface and the second surface of the vibrating diaphragm are not overlapped with each other, or overlapped no more than 20%.

The regular wiring includes wiring forms of a triangle, a nested triangle, a circle, a nested circle, a ring, a nested ring, a screw shape, a polygon, a nested polygon, a five-pointed star, a nested five-pointed star.

The conductive material of the first sub-coil circuit and the second sub-coil circuit includes gold, platinum, copper and iron, the magnetic element 3 includes permanent magnets, electromagnets and artificial magnets, and the magnetic element includes bar magnets with a number of 1 to 50, which are symmetrical and parallel arranged or staggered and parallel arranged.

The first plane shape includes a triangle, a quadrangle, a circle, an oval, and an irregular zigzag shape.

The transducer vibrating diaphragm structure of a flat panel speaker of claim 1, wherein the fixed connection is not limited to flexible connection, rivet connection, glue connection, soldering, bonding, electrostatic connection, and laser welding.

The fixed connection includes being integrated with the vibrating diaphragm.

The macroshape of vibrating diaphragm is a parallel wave shape, or a staggered wave shape, or a water wave circle.

The series or parallel circuit may be fabricated to 1 to 100 layers.

The transducer vibrating diaphragm structure is a rectangular vibrating diaphragm of 10 mm*12 mm.

The transducer vibrating diaphragm structure is a circular vibrating diaphragm with a diameter no more than 12 mm.

The vibrating diaphragm structure is fixed on an annular rigid frame, and in order to improve strength and an inherent frequency of the rigid frame, an integral interior support structure can be disposed inside the annular rigid frame.

The bar magnets in the magnetic element can use neodymium iron boron magnets in an interlocking arrangement.

The bar magnets in the magnetic element can use ferrite bar magnets in an interlocking arrangement.

The first sub-coil and the second sub-coil are formed of a conductive material in a regular wiring, and are disposed at a center position of the vibrating diaphragm. The first sub-coil and the second sub-coil are tortuous helixes or reciprocating staggered structures.

The transducer vibrating diaphragm of a miniature flat panel speaker and the speaker structure having the same provided in the present invention form a composite structural vibrating diaphragm coil of the flat panel transducer by the way of connecting multiple coils in series, wherein one kind of coil is made of gold or platinum with good ductility, and another kinds of coil is made of a metal material with better ductility. The coil is controlled by controlling length and area of the two coils, thereby controlling sound characteristics of the transducer, such that low and high frequency responses and transient are more balanced, and hence a better sound effect is further achieved on the premise of ensuring dimension and sensitivity.

BRIEF DESCRIPTION OF THE DRAWINGS

The following detailed description may be better understood when read in conjunction with the appended drawings. For the purposes of illustration, there are shown in the drawings example embodiments of various aspects of the disclosure; however, the invention is not limited to the specific methods and instrumentalities disclosed.

DESCRIPTION OF ILLUSTRATIVE EMBODIMENTS

Figure 1:
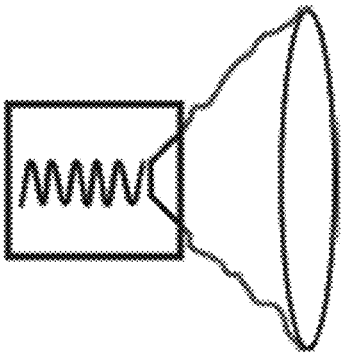
FIG. 1 is a schematic diagram illustrating conventional moving-coil earphone.
Figure 2:
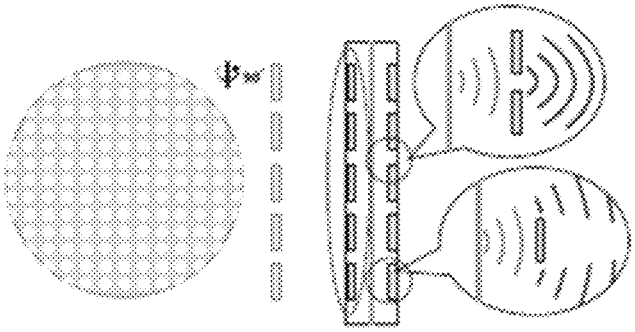
FIG. 2 is a schematic diagram illustrating conventional electrostatic earphone.
Figure 3:
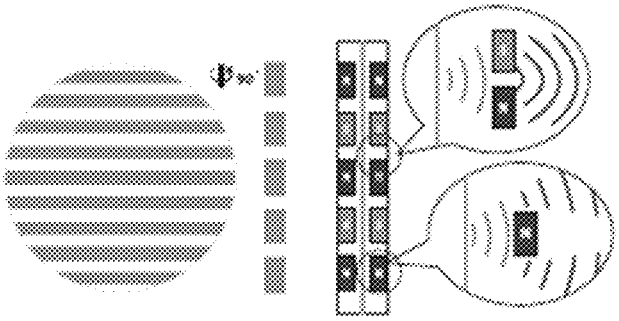
FIG. 3 is a schematic diagram illustrating conventional flat panel earphone.
Figure 4:
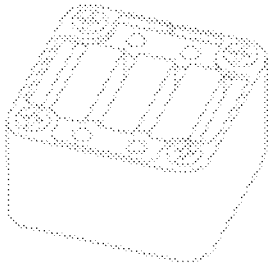
FIG. 4 is a schematic diagram of perspective view illustrating example vibrating diaphragm structure in accordance with the present disclosure.
Figure 5:
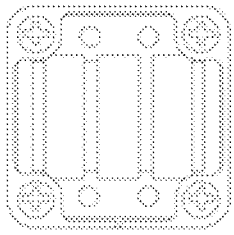
FIG. 5 is a schematic diagram of plane view illustrating example vibrating diaphragm structure in accordance with the present disclosure.
Figure 6:
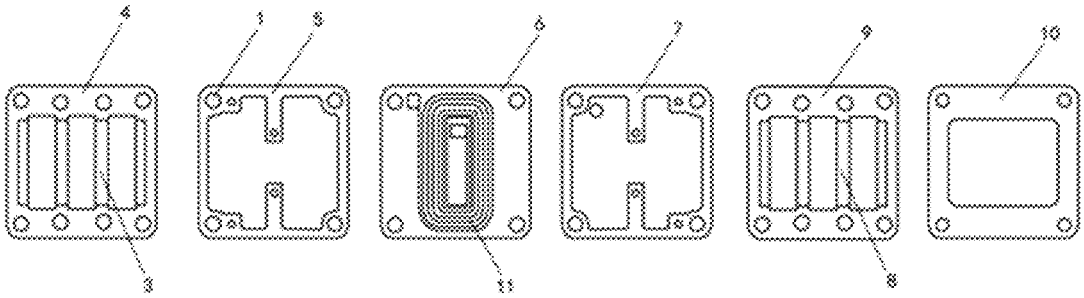
FIG. 6 is a decomposition diagram illustrating example vibrating diaphragm structure in accordance with the present disclosure.

Hereinafter a further detailed description of the present invention will be provided in connection with the appended drawings, so as to facilitate understanding for those skilled in the same field:

As shown in FIGS. 4-7, reference signs respectively represent: fastening screws 1, outer support frame 2, first magnetic element 3, first magnetic frame 4, first coil frame 5, diaphragm 6, second coil frame 7, second magnetic element 8, second magnetic frame 9, fixing plate 10, and coil circuit 11.

EXAMPLE 1

Figure 7:
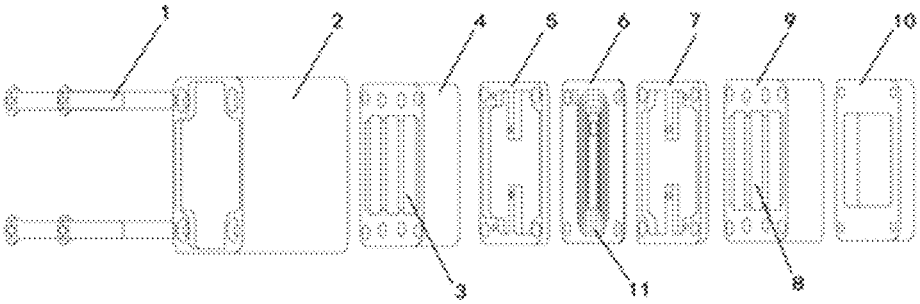
FIG. 7 is an exploded diagram illustrating example vibrating diaphragm structure in accordance with the present disclosure.

As shown in FIG. 7, FIG. 7 is an exploded diagram of the vibrating diaphragm structure in one embodiment of the present disclosure. Firstly, the Example provides a transducer vibrating diaphragm structure of a miniature flat panel speaker, comprising the vibrating diaphragm 6 having a plane shape and a periphery of the diaphragm 6 fixed on the first coil frame 5 and the second coil frame 7, the vibrating diaphragm 6 comprising a first surface and a second surface opposite the first surface. The vibrating diaphragm 6 is a rectangular vibrating diaphragm with a shape of rectangle, and a dimension of 10 mm*12 mm. According to actual needs of work, the dimension may be further set to different dimensions from 1 mm*12 mm to 10 mm*1 mm, such as, dimensions no more than 120 square millimeters including 5 mm*8 mm, 2 mm*3 mm, 4 mm*7 mm, and the like. The periphery of the vibrating diaphragm 6 is fixed onto the frame by the fastening screws 1 that pass through the outer support frame 2, and then connected to the fixing plate 10.

The vibrating diaphragm 6 is laid with a first coil circuit (corresponding to a first coil) and a second coil circuit (corresponding to a second coil) on the first surface and the second surface of the diaphragm 6, respectively. The first magnetic element 3 and the second magnetic element 8 are disposed at two sides of the vibrating diaphragm 6 through the first magnetic frame 4 and the second magnetic frame 9. The first coil circuit and the second coil circuit are deposited on the first surface and the second surface of the vibrating diaphragm 6 via vapor deposition or liquid deposition. The first coil circuit and the second coil circuit are connected in series or in parallel.

The first coil and the second coil are formed of a conductive material in a regular wiring, and are disposed at a center position of the vibrating diaphragm 6. It can be further adjusted to an arrangement way of having coils on a single surface, or an arrangement way of having coils on both surfaces according to designed sensitivity. The first coil and the second coil are formed in a shape of tortuous helixor reciprocating staggered structure. The first coil and the second coil are provided on two sides of the diaphragm, respectively. A first projection of the first coil circuit and a second projection of the second coil circuit on the plane of the vibrating diaphragm do not overlap each other, and the first and second coil circuit are uniformly arranged on the vibrating diaphragm 6. Alternatively, an overlap of the first projection and the second projection is less than or equal to 20%. Meanwhile, a voice coil assembly consisting of the first coil and the second coil is rotationally symmetrical around a center of the vibrating diaphragm.

Figure 9:
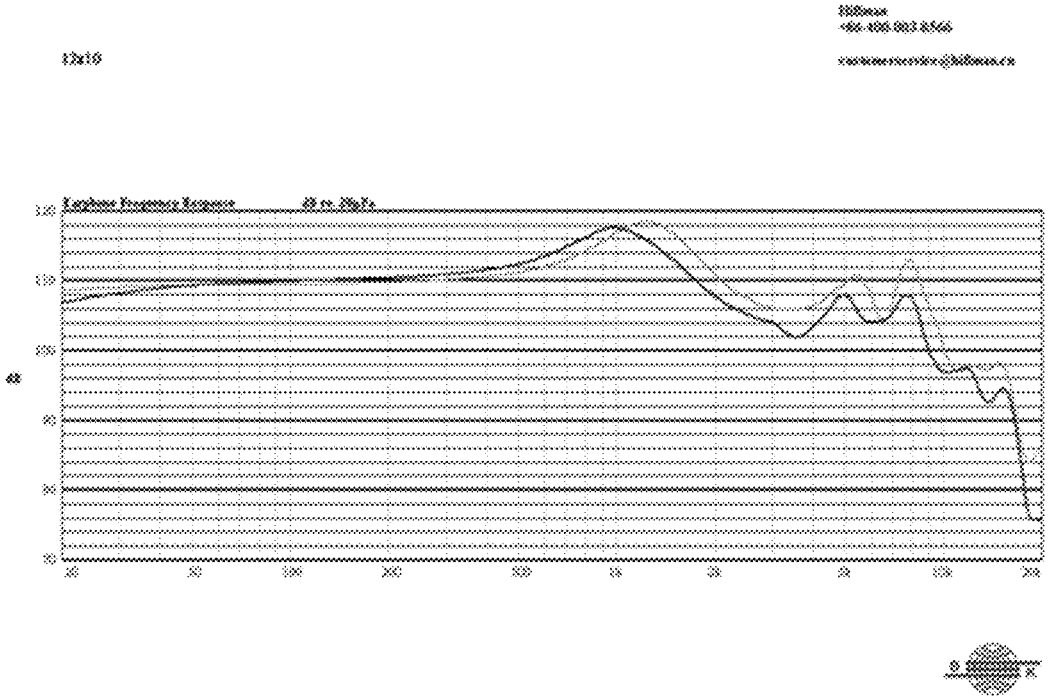
FIG. 9 is a curve diagram illustrating sensitivity test result of example rectangular vibrating diaphragm structure in accordance with the present disclosure.

The above Example is an ideal earphone fabrication structure that is finally found to balance a dimension of the vibrating diaphragm less than 120 square millimeters and a sensitivity greater than 105 dB after the applicant have made theoretical correction of innovation and long-term research. Please refer to a curve diagram of sensitivity test as illustrated in FIG. 9 after the rectangular vibrating diaphragm structure is on the machine. Further, on the premise of ensuring sufficient stability in a vibration state and also reducing the coil mass as much as possible, the first sub-coil or the second sub-coil has a thickness of 50 nm to 10 μm, and the vibrating diaphragm has a thickness of 100 nm to 20 μm. Preferably, a total thickness of the diaphragm including the first and second coils is approximately in a range from 50 nm to 1 μm.

The bar magnets in the magnetic element 3 use neodymium iron boron bar magnets in an interlocking arrangement. In addition, since sensitivity of the vibrating diaphragm is not dramatically reduced in the case of reducing the dimension of the vibrating diaphragm in the present disclosure, on the premise of ensuring a certain degree of total harmonic distortion, ferrite magnets can be further used to replace the neodymium iron boron magnets to reduce costs.

Preferably, the length of the first coil is m-th power times of 10 of the length of the second coil, wherein $0 \leq m \leq 5$, the projection area of the first coil is s-th power times of 10 of the projection area of the second coil, wherein $-3 \leq s \leq 6$, and the mass of the first coil having the same projection area is n-th power times of 10 of a mass of the second coil, wherein $-3 \leq n \leq 5$, and wherein m, s and n are dimensionless parameters.

As for the electrical connection structure, based on the available connection way of the coils and wires, it is commonly known technology for those skilled in the art, so no repetition here.

EXAMPLE 2

The Example provides another transducer vibrating diaphragm structure, and it differs from Example 1 in that the vibrating diaphragm is a circular vibrating diaphragm with a diameter of 12 mm, and also may be further set to other diameters no more than 12 mm, such as, 1 mm, 2 mm, 5 mm, 10 mm, 11 mm and the like, and the magnets are annular magnets, circular magnets or helical magnets. Relative to the structure in Example 2, the rectangular vibrating diaphragm in Example 1 is simpler in fabrication process, and relatively lower in costs, and it is a preferable scheme.

EXAMPLE 3

Figure 8:
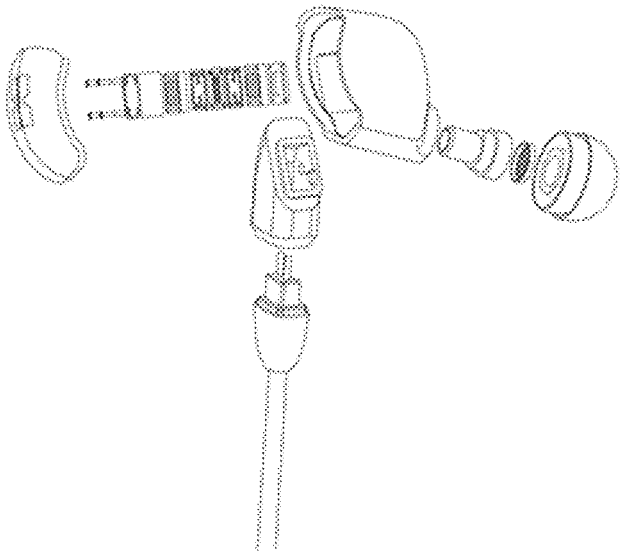
FIG. 8 is an exploded diagram illustrating example earphone in accordance with the present disclosure.

The Example provides an earphone having the transducer vibrating diaphragm in Example 1 or Example 2, and the structure is shown in FIG. 8. FIG. 8 is an exploded diagram of earplug application of a speaker structure in one embodiment of the present disclosure. The Example provides a flat panel earplug having earphone cables, an earplug housing and a built-in flat panel vibrating diaphragm unit, wherein the flat panel vibrating diaphragm unit is described as the contents in Example 1 and Example 2, and no repetition here.

Embodiments of the present disclosure are explicitly explained through the above examples. However, those ordinary in the art shall understand that the above examples are merely one of preferable examples of the present disclosure. Due to limitation of length of the article, it is impossible to list all embodiments, and any implementation that can embody the technical solution of the claims of the present disclosure is within the extent of protection of the present disclosure.

It shall be noted that the above contents are further detailed description of the present invention in connection with the detailed embodiments, and cannot be regarded that the detailed embodiments of the present invention are limited thereto. Under the guidance of the above Examples, those skilled in the art can make various modifications and variations on the basis of the above Examples, and these modifications or variations fall into the extent of protection of the present invention.

What is claimed is:

1. A transducer vibrating diaphragm structure, comprising:

a diaphragm comprising a first surface and a second surface opposite the first surface, wherein a first coil circuit is provided on the first surface of the diaphragm via vapor deposition or liquid deposition, wherein the first coil circuit is formed of a conductive material, wherein a total area of the diaphragm is less than or equal to 120 square millimeters, and wherein a sensitivity of the diaphragm is greater than 105 dB;

a first frame and a second frame disposed at two sides of the diaphragm corresponding to the first surface and the second surface, respectively, wherein a periphery of the diaphragm is coupled to the first frame and the second frame; and a first magnetic element and a second magnetic element disposed to correspond to the first surface and the second surface, respectively, wherein the first magnetic element and the second magnetic are provided on a third frame and a fourth frame, respectively.

2. The transducer vibrating diaphragm structure of claim 1, wherein a second coil circuit is provided on the second surface of the diaphragm via vapor deposition or liquid deposition, and wherein the second coil circuit and the first coil circuit are connected in series or in parallel.

3. The transducer vibrating diaphragm structure of claim 2, wherein a first projection of the first coil circuit on the first surface and a second projection of the second coil circuit on the second surface of the diaphragm do not overlap each other, or an overlap of the first projection and the second projection is less than or equal to 20%.

4. The transducer vibrating diaphragm structure of claim 2, wherein a wiring of the first coil circuit or the second coil circuit has a shape of a triangle, a nested triangle, a circle, a nested circle, a ring, a nested ring, a screw shape, a polygon, a nested polygon, a five-pointed star, or a nested five-pointed star.

5. The transducer vibrating diaphragm structure of claim 2, wherein the conductive material of the first coil circuit and the second coil circuit comprises gold, platinum, copper or iron, wherein the first magnetic element and the second magnetic element comprise permanent magnets, electromagnets, or artificial magnets, and wherein the first magnetic element or the second magnetic element comprises one or more bar magnets in a range of numbers from 1 to 50, the one or more bar magnets being arranged symmetrically and in parallel or arranged staggeredly and in parallel.

6. The transducer vibrating diaphragm structure of claim 1, wherein a shape of the diaphragm comprises a triangle, a quadrangle, a circle, an oval, or an irregular zigzag shape.

7. The transducer vibrating diaphragm structure of claim 1, wherein the periphery of the diaphragm is coupled to the first frame and the second frame by a flexible connection, rivet connection, glue connection, soldering, bonding, electrostatic connection, or laser welding.

8. The transducer vibrating diaphragm structure of claim 1, wherein the diaphragm is integrally formed with the first frame and the second frame.

9. The transducer vibrating diaphragm structure of claim 2, wherein series or parallel circuits formed by the first coil circuit and the second coil circuit comprise one or more layers in a range of numbers from 1 to 100.

10. The transducer vibrating diaphragm structure of claim 1, wherein the diaphragm has a rectangular shape.

11. The transducer vibrating diaphragm structure of claim 1, wherein the diaphragm has a circular shape, wherein a diameter of the circular diaphragm is less than or equal to 12 mm.

12. The transducer vibrating diaphragm structure of claim 2, wherein a thickness of the first coil circuit or the second coil circuit is in a range from 50 nm to 10 μm, and wherein a thickness of the diaphragm is in a range from 100 nm to 20 μm.

13. A flat panel speaker, comprising:

a transducer vibrating diaphragm structure, wherein the transducer vibrating diaphragm structure comprises:

a diaphragm comprising a first surface and a second surface opposite the first surface, wherein a first coil circuit is provided on the first surface of the diaphragm via vapor deposition or liquid deposition, wherein the first coil circuit is formed of a conductive material, wherein a total area of the diaphragm is less than or equal to 120 square millimeters, and wherein a sensitivity of the diaphragm is greater than 105 dB, a first frame and a second frame disposed at two sides of the diaphragm corresponding to the first surface and the second surface, respectively, wherein a periphery of the diaphragm is coupled to the first frame and the second frame, and a first magnetic element and a second magnetic element disposed to correspond to the first surface and the second surface, respectively, wherein the first magnetic element and the second magnetic are provided on a third frame and a fourth frame, respectively; and a support frame configured to provide a rigid support to the transducer vibrating diaphragm structure, the transducer vibrating diaphragm structure being mounted on the support frame.

14. The flat panel speaker of claim 13, wherein a second coil circuit is provided on the second surface of the diaphragm via vapor deposition or liquid deposition, and wherein the second coil circuit and the first coil circuit are connected in series or in parallel.

15. The flat panel speaker of claim 14, wherein a first projection of the first coil circuit on the first surface and a second projection of the second coil circuit on the second surface of the diaphragm do not overlap each other, or an overlap of the first projection and the second projection is less than or equal to 20%.

16. The flat panel speaker of claim 13, wherein the diaphragm has a rectangular shape.

17. The flat panel speaker of claim 13, wherein the diaphragm has a circular shape, wherein a diameter of the circular diaphragm is less than or equal to 12 mm.

18. An earphone, comprising:

a transducer vibrating diaphragm structure, wherein the transducer vibrating diaphragm structure comprises:

a diaphragm comprising a first surface and a second surface opposite the first surface, wherein a first coil circuit is provided on the first surface of the diaphragm via vapor deposition or liquid deposition, wherein the first coil circuit is formed of a conductive material, wherein a total area of the diaphragm is less than or equal to 120 square millimeters, and wherein a sensitivity of the diaphragm is greater than 105 dB, a first frame and a second frame disposed at two sides of the diaphragm corresponding to the first surface and the second surface, respectively, wherein a periphery of the diaphragm is coupled to the first frame and the second frame, and a first magnetic element and a second magnetic element disposed to correspond to the first surface and the second surface, respectively, wherein the first magnetic element and the second magnetic are provided on a third frame and a fourth frame, respectively; and a housing configured to contain the transducer vibrating diaphragm structure.

19. The earphone of claim 18, wherein a second coil circuit is provided on the second surface of the diaphragm via vapor deposition or liquid deposition, and wherein the second coil circuit and the first coil circuit are connected in series or in parallel.

20. The earphone of claim 19, wherein a first projection of the first coil circuit on the first surface and a second projection of the second coil circuit on the second surface of the diaphragm do not overlap each other, or an overlap of the first projection and the second projection is less than or equal to 20%.

* * * * *